United States Patent [19]

Ben-Dov

[11] 3,943,522

[45] Mar. 9, 1976

[54] CIRCULARLY POLARIZED ANTENNA SYSTEM USING A COMBINATION OF TURNSTILE AND VERTICAL DIPOLE RADIATORS

[75] Inventor: Oded Ben-Dov, Medford, N.J.

[73] Assignee: RCA Corporation, New York, N.Y.

[22] Filed: Sept. 20, 1974

[21] Appl. No.: 507,707

[52] U.S. Cl. ..... 343/797; 343/798; 343/890

[51] Int. Cl.[2] ..... H01Q 21/26

[58] Field of Search ..... 343/727, 797, 798, 799, 343/800, 890

[56] References Cited

UNITED STATES PATENTS

| | | | |
|---|---|---|---|
| 2,688,081 | 8/1954 | Laport | 343/798 |
| 2,781,513 | 2/1957 | Peterson | 343/798 |

*Primary Examiner*—Eli Lieberman

*Attorney, Agent, or Firm*—Edward J. Norton; Robert L. Troike

[57] ABSTRACT

A circularly polarized antenna system adapted to provide an omnidirectional pattern over a fairly broad band of frequencies when mounted to a sizable tower is provided by four turnstile fed horizontally polarized radiating elements spaced at 90° intervals about the support tower and by four vertically polarized dipoles with each vertically polarized dipole mounted vertically spaced from a respective one of the four radiating elements. The four vertically polarized dipoles are spaced from each other and are fed in a manner to cause the horizontal pattern of the vertically polarized field associated with the vertically polarized dipoles to be of similar shape and magnitude and in phase quadrature to the horizontal pattern of the horizontally polarized field associated with the four horizontally polarized radiating elements.

6 Claims, 8 Drawing Figures

Fig. 2
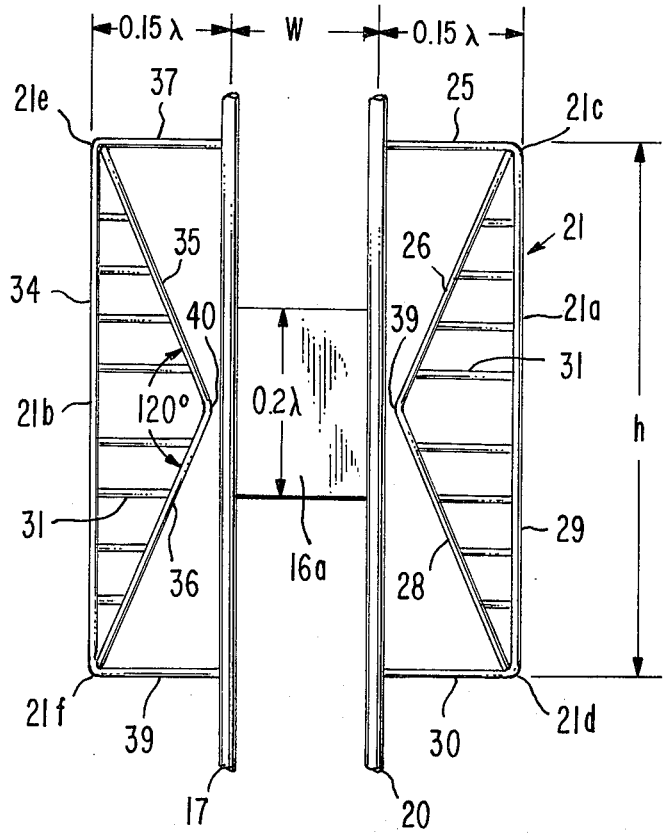
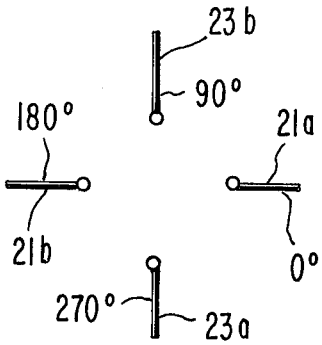
Fig. 3
Fig. 4
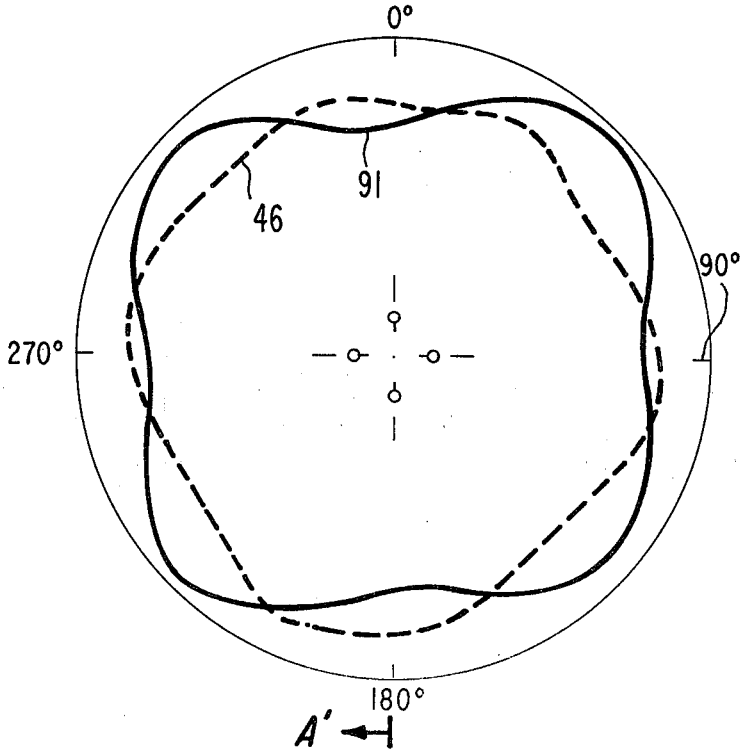

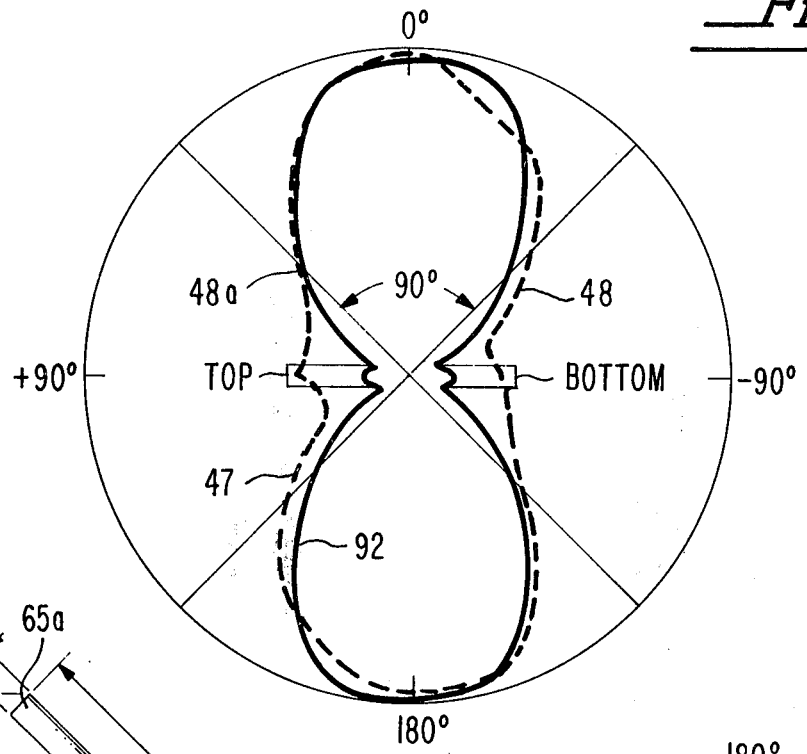
Fig. 5
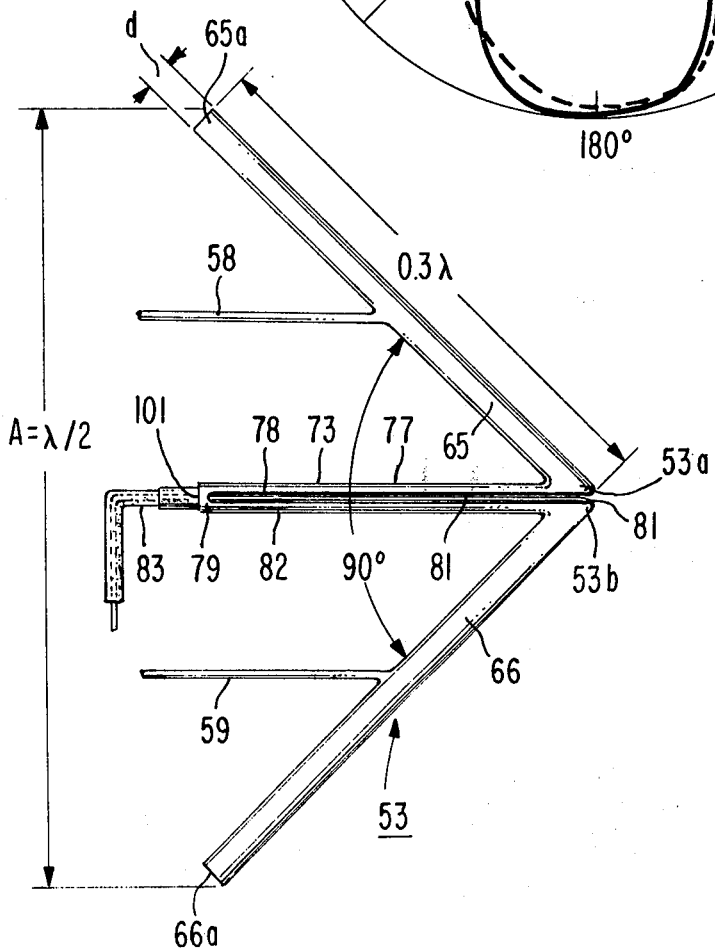
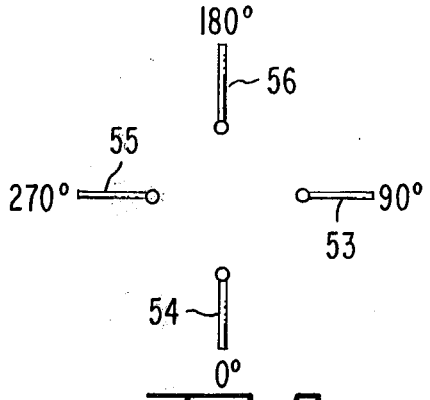
Fig. 7
Fig. 6

CIRCULARLY POLARIZED ANTENNA SYSTEM USING A COMBINATION OF TURNSTILE AND VERTICAL DIPOLE RADIATORS

BACKGROUND OF THE INVENTION

This invention relates to circularly polarized antennas and more particularly to circularly polarized antennas for use in FM radio or in television broadcasting where the antennas are mounted to the sides of a support mast or tower capable of supporting other antenna systems for other stations or channels. This invention more particularly relates to an antenna which when mounted on this mast or tower radiates in an omnidirectional pattern about the tower such that when this tower is erected in the center of a city, for example, substantially equal coverage is provided about the city. The problem of equal coverage about the tower becomes increasingly difficult as the diameter of the tower becomes largerr with attendant cloverleaf radiation patterns. These tower diameters tend to become fairly large if the tower supports many antenna systems for a plurality of broadcasters. The problem becomes increasingly difficult when this omnidirectional pattern is in the circularly polarized mode.

Although horizontally polarized television broadcasting has been almost exclusively used in the USA, it appears from some recent test results, that circularly polarized broadcasting might well greatly improve television reception both in large metropolitan areas and in fringe areas. It is highly desirable in fringe areas to provide a circularly polarized omnidirectional antenna suitable for television broadcasting and particularly suitable for broadcasting at frequencies as low as 50 MHz where the percentage bandwidth is quite large.

BRIEF DESCRIPTION

Briefly, a circularly polarized antenna system is provided about a vertically oriented support tower by a turnstile radiating system including four radiating elements spaced about the tower and a system of four vertically oriented dipoles spaced vertically from the radiating elements. The four radiating elements in the turnstile radiating system extend horizontally at 90° intervals. These four radiating elements are fed with equal power in the relative phase rotation of 0°, 90°, 180° and 270°. The four vertically oriented dipoles are fed with equal power in the relative phase rotation of 0°, 90°, 180° and 270°. The four vertically oriented dipoles are spaced from each other and fed in an amplitude and phase relationship relative to the radiating elements to cause the horizontal pattern of the vertically polarized field associated with the vertical dipoles to be of similar shape and magnitude and in phase quadrature to the horizontally polarized field associated with the four radiating elements.

DETAILED DESCRIPTION OF INVENTION

A more detailed description of a preferred embodiment of the present invention follows in conjunction with the following drawings wherein:

FIG. 2 is a sketch of a portion of the turnstile antenna system illustrating two of the four horizontal radiating elements.

FIG. 3 is a sketch illustrating how the four horizontal radiating elements of the turnstile antenna system may be fed.

FIG. 4 illustrates horizontal patterns associated with the antenna system of FIG. 1 according to the present invention.

FIG. 5 illustrates the vertical patterns associated with the antenna system of FIG. 1 as viewed in the 0°–180° primary axis of FIG. 4 or in the direction of arrows A-A′ of FIG. 4.

FIG. 6 is an elevation view of one of the four vertically oriented dipoles.

FIG. 7 illustrates the relative phases between the vertical dipoles in the system of FIG. 1.

Figure 1:
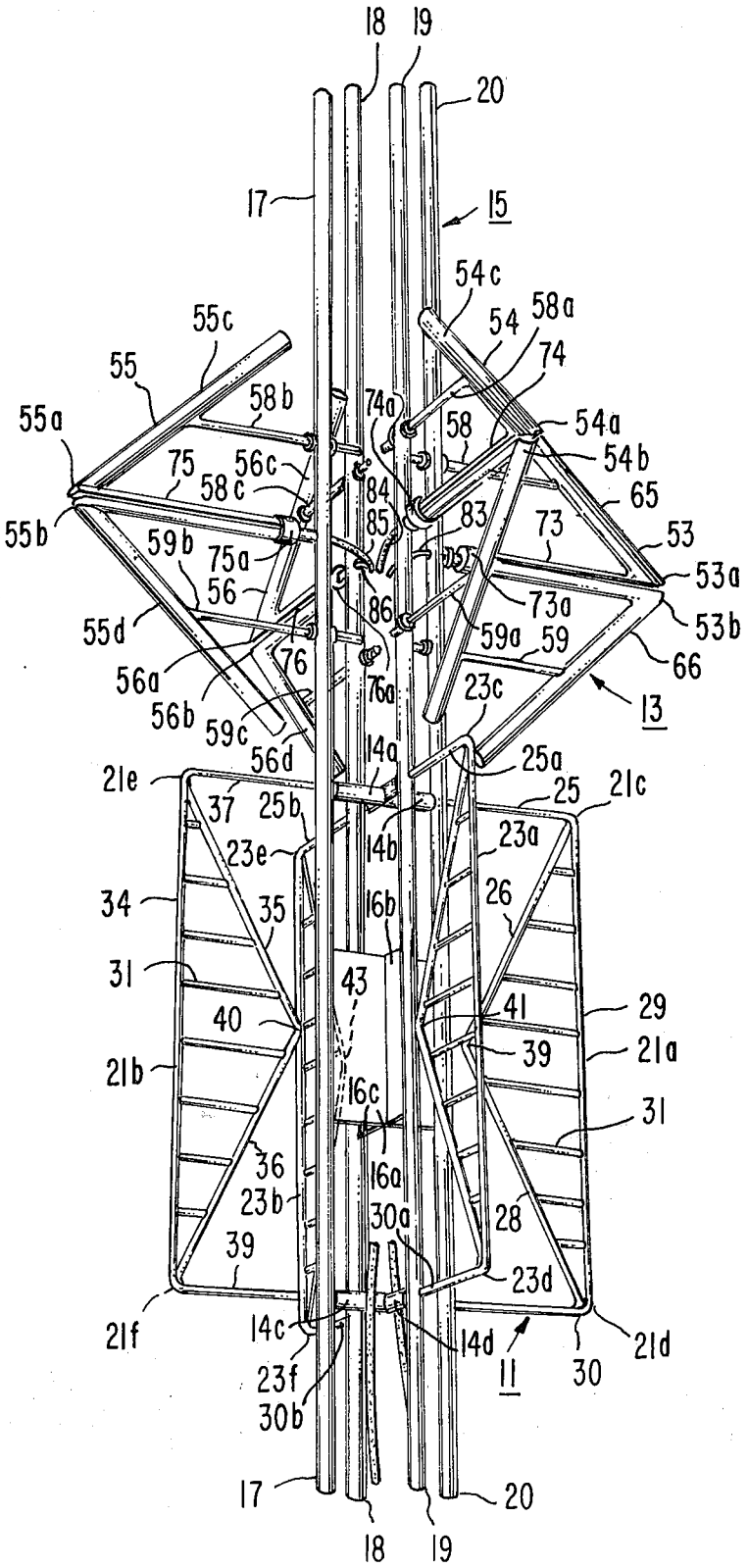
FIG. 1 is a perspective view of an antenna system according to a preferred embodiment of the present invention.

Referring to FIG. 1, there is illustrated a circularly polarized antenna system comprising a turnstile antenna subsystem 11 for exciting horizontally polarized radiation and a subsystem 13 of four vertically oriented dipoles for exciting vertically polarized radiation. The turnstile antenna subsystem 11 is mounted to tower 15 below the subsystem 13 of four vertically oriented dipoles 53, 54, 55 and 56. The tower 15 is made up of four posts 17, 18, 19 and 20 which posts form the corners of a square tower. The tower 15 includes crossed support posts 14*a*, 14*b*, 14*c* and 14*d* and conductive support plates 16*a*, 16*b*, and 16*c* which connect the posts 17, 18, 19 and 20 to each other.

The turnstile antenna subsystem 11 is made up of horizontal radiating elements 21*a* and 21*b* and orthogonally crossed horizontal radiating elements 23*a* and 23*b*. The elements 21*a*, 21*b*, 23*a* and 23*b* as shown in FIGS. 1 and 2 are triangular-shaped elements. The triangular-shaped radiating elements 21*a* has a vertically oriented side 29 and two diagonal arms 26 and 28. The diagonal arms 26 and 28 join each other at feed point 39 with the angle between the arms 26 and 28 being about 120°. The corners 21*c* and 21*d* are mounted to the support post 20 by horizontally extending posts 25 and 30, respectively.

Similarly, radiating element 21*b* is a triangular-shaped element having a vertically oriented member 34 and two diagonal members 35 and 36 with the intersection of the diagonal members 35 and 36 being at feed point 40. The angle between the diagonal arms 35 and 36 is about 120°. The corners 21*e* and 21*f* of the triangular element 21*b* are mounted to the support post 17 via horizontal posts 37 and 39. The posts 17 and 20 are electrically connected to each other by conductive plate 16*a* extending therebetween over a height of at least about 0.2 wavelength centered with respect to feed points 39 and 40. The dimensions in wavelengths as used herein refers to the wavelength at the center operating frequency of the antenna system. This plate 16*a* may be a plurality of rods approximating a conductive sheet or plate connected between the two support posts. The width W (see FIG. 2) of the tower 15 or the spacing between posts 17 and 20 plus the width of the posts 17 and 20 in this particular example is about 0.15 wavelength. The element 21*a* extends a length $l_1$ in a horizontal plane about 0.15 wavelength from the post 20 to points 21*c* and 21*d*. Similarly, the element 21*b* extends a length $l_2$ in a plane about 0.15 wavelength at the center operating frequency of the antenna from the post 17 to the points 21*e* and 21*f*. The feed point corners 39 and 40 are about 0.085 wavelength from the posts 20 and 17 respectively.

The height ($h$) of the remote ends or sides 29 and 34 of the elements 21*a* and 21*b*, respectively, is on the order of 0.48 wavelength. The triangular radiating elements 21*a* and 21*b* have between the diagonal arms and the vertical arm a plurality of conductive rods 31 which rods extend in a horizontal plane and are sufficient in number to form by the triangular structure the equivalent of a triangular-shaped conductive sheet. The triangular structure could equally well be a conductive sheet rather than the equivalent made up of rods. However, the rod-like structure described is more suitable in outside installations to reduce wind loading.

The radiating elements 23*a* and 23*b* are oriented in a plane orthogonal to the above-described radiating elements 21*a* and 21*b* and are similar to that described above. See FIG. 1. The triangular radiating element 23*a* is like radiating element 21*a* with its corners 23*c* and 23*d* mounted by posts 25*a* and 30*a* to post 19 a distance of approximately 0.15 wavelength in a radial direction. Similarly, element 23*b* is like triangular element 21*b* and is mounted by posts 25*b* and 30*b* with the corners 23*e* and 23*f* about 0.15 wavelength in a radial direction from post 18. The feed points 41 and 43 for the radiating elements 23*a* and 23*b* are located approximately 0.085 wavelength from the post 19 and 18, respectively. A conductive plate 16*b* extends from post 19 to plate 16*a* and a conductive plate 16*c* extends from post 18 to plate 16*a*. The conductive plates 16*b* and 16*c* are joined at the center of the tower 15 to plate 16*a* and are each about 0.2 wavelength high with equal amounts extending above and below points on the tower adjacent feed points 41 and 43.

Referring to FIG. 3, the four horizontal radiating elements 21*a*, 21*b*, 23*a* and 23*b* extending at 90° intervals from tower 15 are fed in a turnstile manner wherein these radiating elements 21*a*, 23*b*, 21*b* and 23*a* are phased in the relative phase manner of 0°, 90°, 180° and 270° respectively with equal power to each element. Under these relative phase and power conditions an essentially omnidirectional horizontal pattern of horizontally polarized radiation is produced as shown by pattern 46 (dashed lines) in FIG. 4. FIG. 5 illustrates the vertical pattern produced in the 0°–180° axis of FIG. 4 in the direction of arrows A-A′ of FIG. 4. The pattern for the horizontally polarized radiation is essentially like that shown by dashed lines 47 in FIG. 5. The angle between the half power points 48 and 48a in the vertical plane is about 90°.

Referring to FIG. 1, there is illustrated the antenna subsystem 13 for exciting vertically polarized radiation using four vertically oriented dipoles 53, 54, 55 and 56 and four coaxial transmission lines 83 thru 86. Dipole element 53 is mounted vertically to post 20 via rods 58 and 59. Dipole 54 is mounted to post 19 via rods 58*a* and 59*a*. Dipole element 55 is mounted vertically to post 17 via rods 58*b* and 59*b*, and dipole element 56 is mounted vertically to post 18 via rods 58*c* and 59*c*. The dipole element 53 is mounted directly above element 21a and directly opposite dipole element 55. The dipole elements 54 and 56 are directly above and in line with the radiating elements 23*a* and 23*b*. The coaxial transmission lines 83 thru 86 are passed around the posts 20, 19, 17 and 18 and connected to baluns 73 thru 76 respectively at points 73*a* thru 76*a*. The vertical dipoles 53 thru 56 are coupled to baluns 73 thru 76 respectively at feed points 53*a*, 53*b*, 54*a*, 54*b*, 55*a*, 55*b*, 56*a* and 56*b*, respectively. The points 73*a*, 74*a*, 75*a* and 76*a* at the junction of the baluns 73 thru 76 and the feed lines 83 thru 86 are approximately 0.6 wavelength in a vertical direction from the feed points 39, 40, 41 and 43 of turnstile antenna system 11.

Referring to FIG. 6, there is shown an elevation view of one of the vertical dipoles 53. The vertical dipole 53 is made up of element portions 65 and 66 which are at an angle of 90° with respect to each other. The diameter of the elements 65 and 66 together with the length is made such that the electrical length of the element from end 65*a* to feed point 53*a* and from end 66*a* to the feed point 53*b* is electrically a half wavelength ($\lambda/2$). The actual mechanical length is only 0.3 wavelength. The diameter, $d$, of elements 65 and 66 itself is approximately 0.023 wavelength. In this manner the dipole 53 is electrically a full wavelength dipole and consequently has the fairly broad bandwidth impedance characteristic of a full wave dipole. The aperture, A, presented by the dipole 53 in the vertical plane is actually about a half wavelength. By making this aperture approximately a half wavelength, the vertical pattern characteristics of the vertically polarized radiation therefrom in the vertical plane is broader than the full wavelength dipole and is substantially like that of a half wavelength dipole. Dipoles 54, 55 and 56 are similarly constructed.

The rod 58 is fixed to element 65 at the midpoint between the end 65*a* and feed point 53*a*. Similarly, rod 59 is fixed to element 66 at the midpoint between the end 66*a* and the feed point 53. Similarly, rods 58*a* and 59*a* are fixed to dipole 54, rods 58*b* and 59*b* are fixed to dipole 55 and rods 58*c* and 59*c* are fixed to dipole 56. By making the dipoles 53, 54, 55 and 56 electrically full wave dipoles, these supports for the dipoles (such as supports 58 and 59, for example, of elements 65 and 66 of dipole 53) are placed at voltage nulls.

The balun 73 for dipole 53 in FIG. 6 includes a pair of slots 78 (one on each side) in the outer conductor 82 of a section of coaxial transmission line 77. These slots 78 in the section of coaxial transmission line 77 in FIG. 6 extends from the feed points 53*a* and 53*b* a length of $\lambda/4$ (one quarter wavelength) at the center operating frequency to a shorted end 79. At the feed point end 53b an inner conductor 81 of the coaxial transmission line 77 is connected to lower element 66 and the outer conductor 82 is connected to element 65. This arrangement transforms the impedance from an unbalanced coaxial line 83 of 75 ohms characteristic impedance at end 101 to a balanced impedance of 300 ohms at the feed points 53*a* and 53*b* of the dipole 53.

With the proper selection of the spacing, phase and energy between the vertical dipoles and the proper selection of the phase and energy between the horizontally polarized radiating elements and the vertically polarized dipoles, the pattern coverage of the vertically polarized radiation associated with the two vertical dipoles 54 and 56 closely matches that associated with the orthogonally oriented turnstile radiating elements 21*a* and 21*b*. Similarly the total pattern coverage of the vertically polarized radiation associated with the two vertical dipoles 53 and 55 closely matches that associated with the orthogonally oriented turnstile radiating elements 23*a* and 23*b*.

As shown in FIG. 1, dipoles 53 and 55 are spaced back to back in a horizontal plane from each other and dipoles 54 and 56 are spaced back to back in a horizontal plane from each other. The dipoles 53 and 55 are fed 180° out of phase by equal length feed lines 83 and 85 and the dipoles 54 and 56 are fed 180° out of phase by feed lines 84 and 85 of equal length to feed lines 83 and 86. The spacing between the dipoles 53 and 55 in this particular embodiment is 0.6 wavelength, for example, from remote ends or feed points 53*a*, 53*b* to feed points 55*a* and 55*b*. The spacing between the phase center of the dipole 53 and the phase center of the dipole 55 is 0.5 wavelength. The spacing between dipoles 54 and 56 is the same as between dipoles 53 and 55. The pattern 92 (solid lines) in FIG. 5 illustrates this vertical pattern of the vertically polarized radiation as viewed in the 0°–180° axis or in the direction of arrows A-A′ of FIG. 4. It can be seen that the angle between the half power points is, in the vertical plane shown in FIG. 5, approximately 90° and is therefore similar to that associated with horizontally polarized radiation produced in the vertical plane by the turnstile radiating elements 21*a*, 21*b*, 23*a* and 23*b*. When the four vertical dipoles 54, 53, 56 and 55 are fed at their feed points in the relative phase rotation of 0°, 90°, 180° and 270° via cables 83 thru 86 and baluns 73 thru 76 as illustrated in FIGS. 7 and 8, the horizontal pattern 91 as shown in solid line in FIG. 4 of the vertically polarized radiation is substantially omnidirectional.

Since the dipoles 53, 54, 55 and 56 excite vertically polarized radiation and the turnstile radiating elements 21*a*, 21*b*, 23*a* and 23*b* excite horizontally polarized radiation, the fields radiated by the dipoles 53, 54, 55 and 56 are orthogonal to the fields radiated by the four radiating elements 21*a*, 21*b*, 23*a* and 23*b*. As stated previously by the arrangement described above the pattern associated with dipoles 54 and 56 matches that of elements 21*a* and 21*b* and the patterns associated with dipoles 53 and 55 matches that of elements 23*a* and 23*b*. By making the fields associated with dipoles 54 and 56 at phase quadrature to the fields associated with elements 21*a* and 21*b* and by making the fields associated with dipoles 53 and 55 at phase quadrature to the fields associated with elements 23*a* and 23*b* circular polarization is achieved.

Figure 8:
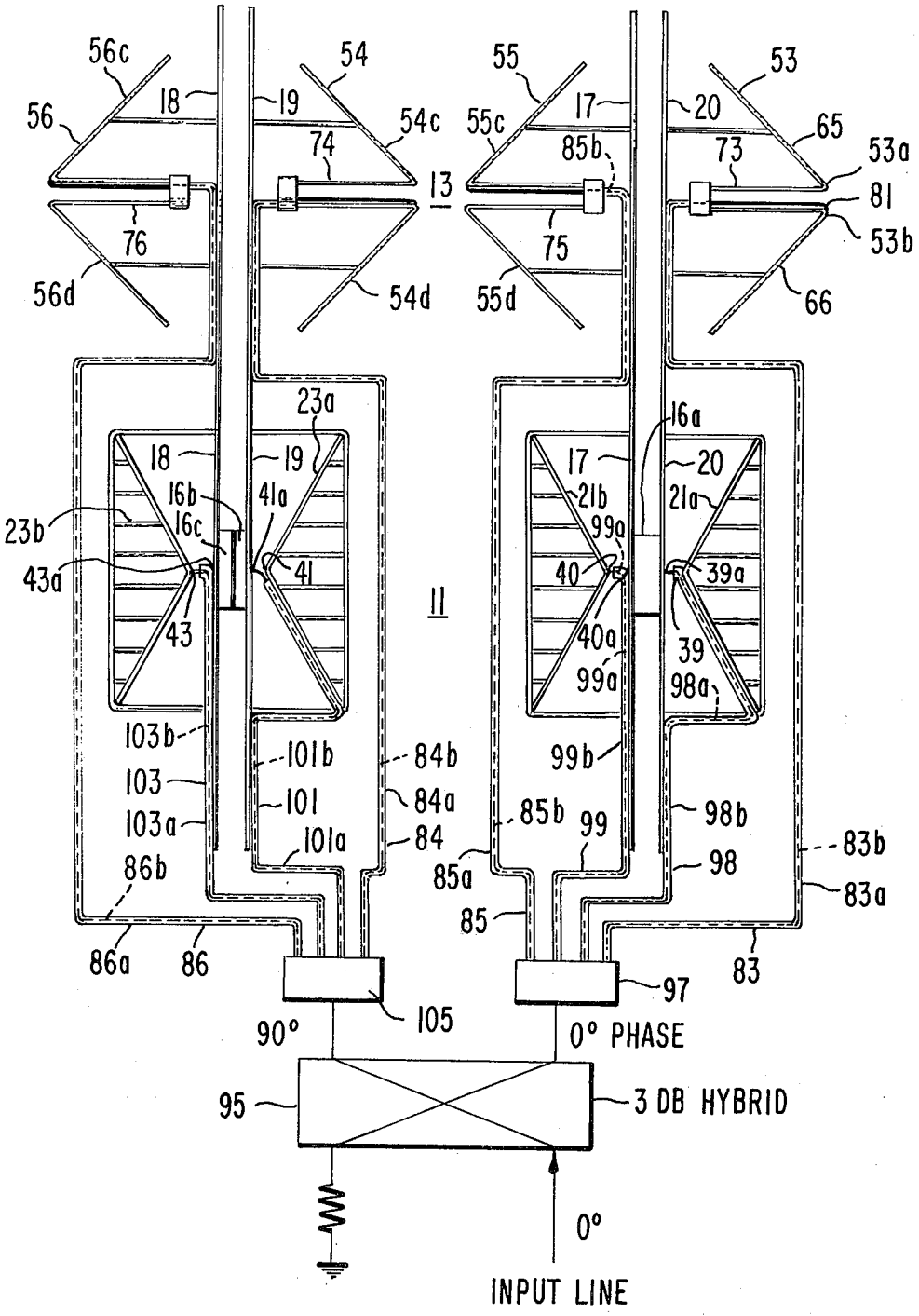
FIG. 8 is a diagram of the feed system.

This quadrature phasing may be provided by the feed arrangements shown in FIG. 8. The total input power is coupled to a 3 db hybrid 95 with one half the power being applied to the first power divider 97. The four coaxial lines 83, 85, 98 and 99 are of equal electrical length and equally split the power coupled to divider 97 with coaxial line 83 coupled to vertically polarized dipole 53, coaxial line 85 coupled to vertical dipole 55, coaxial line 98 coupled to radiating element 21a of coaxial line 99 coupled to radiating element 21*b*. The dipoles 53 and 55 are fed 180° out of phase. Since the outer conductors 83*a* and 85*a* are both connected to the grounding posts 20 and 17 respectively the 180° relative phase difference is provided by the lower element 66 of dipole 53 being connected to the center conductor 83*b* of the coaxial feed line 83 (via element 81) and the upper element 55*c* being connected to the center conductor 85*b* of the coaxial feed line 85. The dipole element 21 is fed 180° out of phase with dipole element 21*a*. The outer conductor 98*b* of feed line 98 is connected to radiating element 21*a* at feed point 39 and the inner conductor 98*a* is connected to post 20 and terminates at point 39*a* opposite feed point 39. The outer conductor 99*b* of feed line 99 is connected to post 17 at a point 40*a* opposite feed point 40 and the inner conductor 99*a* is connected to the radiating portion of element 21*b* and terminates at feed point 40.

The signal coupled to the power divider system 105 is of equal power but phase shifted 90°. The four coaxial lines 84, 86, 101 and 103 are of equal electrical length and equally split the power at power divider 105 with coaxial line 84 coupled to the vertical dipole 54, the coaxial line 86 coupled to the vertical dipole 56, the coaxial line 101 coupled to horizontal element 23*a* and the coaxial line 103 coupled to the horizontal element 23*b*. The dipoles 54 and 56 are fed 180° out of phase. This is accomplished by connecting both the inner conductor 84*b* of coaxial transmission line 84 to the lower element 54*d* of dipole 54 and the inner conductor 86*b* of coaxial transmission line 86 to the upper element 56*c* of dipole 56 while the outer conductors 84*a* and 86*a* are coupled to grounding posts 19 and 18 respectively. The dipole element 23*b* is coupled 180° out of phase with dipole element 23*a*. The inner conductor 101*b* is coupled to post 19 at point 41*a* and the outer conductor 101*a* is coupled to radiating element 23*a* and terminates at feed point 41. The inner conductor 103*b* is coupled to the radiating element 23*b* at feed point 43 and the outer conductor 103*a* is connected to post 18 and terminates at point 43*a*. Since the coaxial lines 84, 86, 101 and 103 have already undergone an extra 90° phase shift, the relative phase at dipole 54 and 56 is 90° and 270° respectively relative to dipole 53 and elements 21*a* and 21*b* are at 90° and 270° respectively relative to element 21*a*. The length of baluns 73 thru 76 extend an extra one quarter wavelength beyond the coaxial lines 83 thru 86 and therefore the dipoles 54 thru 56 are shifted 90° relative to the lower elements 21*a*, 21*b*, 23*a* and 23*b*.

The phase center of the dipoles 53, 54, 55 and 56 are each approximately one quarter wavelength $\lambda/4$ in a horizontal direction from the center of the tower 15. The phase center of the turnstile radiating elements 21*a*, 21*b*, 23*a* and 23*b* is at about the center of the tower 15 (between the arms of either dipole elements 21*a* and 21*b* or 23*a* and 23*b*). The fields from radiating elements 23*a* and 23*b* undergo an additional relative phase shift of 90° when traveling this $\lambda/4$ distance radially to the phase center of dipoles 53 and 55 and consequently the fields from dipoles 53 and 55 are at phase quadrature to those fields from elements 23*a* and 23*b*. Similarly, the fields from radiating elements 21*a* and 21*b* undergo an additional relative phase shift of 90° when traveling this $\lambda/4$ distance radially to the phase center of dipoles 54 and 56 and consequently the fields from dipoles 54 and 56 are at phase quadrature to those fields from elements 21*a* and 21*b*.

What is claimed is:

1. A circularly polarized antenna system comprising:

a vertically oriented support tower, four radiating elements mounted about the tower at 90° intervals with the elements extending from the tower and configured to excite horizontally polarized fields, means for feeding signal energy at a first power level to said four radiating elements with equal power to each radiating element and in relative phase rotation of 0°, 90°, 180° and 270° in the manner of a turnstile, four vertically oriented dipoles mounted to the tower with a vertically oriented dipole spaced vertically a given distance from each radiating element, said vertically oriented dipoles being electrically full wavelength dipoles and being arranged to present the aperture of a half wavelength dipole, means for feeding equal signal energy to each of said four vertically oriented dipoles in relative phase rotation of 0°, 90°, 180° and 270°, said four vertically oriented dipoles being spaced from each other and fed in an amplitude and phase relationship with respect to said four radiating elements to cause the horizontal pattern of the vertically polarized field associated with the vertical dipoles to be of similar shape and magnitude and in phase quadrature to the horizontal pattern of the horizontally polarized field associated with the four radiating elements.

2. The combination claimed in claim 1 wherein one of the vertically oriented dipoles is fed 180° out of phase with a diametrically opposite vertically oriented dipole and is spaced about 0.6 wavelength tip to tip therefrom.

3. The combination claimed in claim 1 wherein each of said four radiating elements are triangular-shaped with the apex near the tower and the height increasing to a maximum at the end remote from the tower.

4. The combination claimed in claim 3 wherein said triangular radiating sections are made up of a plurality of rod-like conductors.

5. A circularly polarized antenna system for operation over a relatively broad band of frequencies comprising:

a vertically oriented support tower, four radiating planar elements mounted about the tower at 90° intervals with each of the planar elements including a grid of conductors extending perpendicular from the tower in a given plane over a vertical length of approximately one half wavelength at a frequency within said broad band of frequencies and configured to excite horizontally polarized fields, means for feeding signal energy at a first power level to said four planar elements with equal power to each radiating planar element and in relative phase rotation of 0°, 90°, 180° and 270° in the manner of a turnstile, four vertically oriented dipoles mounted to the tower with a vertically oriented dipole spaced vertically a given distance from each radiating planar element, means for feeding equal signal energy to each of said four vertically oriented dipoles in relative phase rotation of 0°, 90°, 180° and 270°, said four vertically oriented dipoles being spaced from each other and fed in an amplitude and phase relationship with respect to the signal energy fed to said four radiating planar elements to cause the horizontal pattern of the vertically polarized field associated with the vertical dipoles to be of similar shape and magnitude and in phase quadrature to the horizontal pattern of the horizontally polarized field associated with the four radiating planar elements.

6. A circularly polarized antenna system comprising:

a vertically oriented support tower, four radiating elements mounted about the tower at 90° intervals with the elements extending from the tower and configured to excite horizontally polarized fields, means for feeding signal energy at a first power level to said four radiating elements with equal power to each radiating element and in relative phase rotation of 0°, 90°, 180° and 270° in the manner of a turnstile, four vertically oriented dipoles mounted to the tower with a vertically oriented dipole spaced vertically a given distance from each radiating element, said vertically oriented dipoles being spaced from each other to cause in the presence of signal energy applied thereto the horizontal pattern of the vertically polarized field associated with the vertically oriented dipoles to be of similar shape to the horizontal pattern of the horizontally polarized field associated with the four radiating elements, means for feeding equal signal energy to each of said four vertically oriented dipoles in relative phase rotation of 0°, 90°, 180° and 270°, and in equal amplitude and approximately 90° phase relationship with respect to the signal energy fed to said four radiating elements to cause the horizontal pattern of the vertically polarized field associated with the vertical dipoles to be equal magnitude and in phase quadrature to the horizontal pattern of the horizontally polarized field associated with the four radiating elements.

* * * * *